US009550268B2

(12) United States Patent
Shinozaki

(10) Patent No.: US 9,550,268 B2
(45) Date of Patent: Jan. 24, 2017

(54) SUBSTRATE HOLDING APPARATUS AND POLISHING APPARATUS

(71) Applicant: EBARA CORPORATION, Tokyo (JP)

(72) Inventor: Hiroyuki Shinozaki, Tokyo (JP)

(73) Assignee: Ebara Corporation, Tokyo (JP)

( * ) Notice: Subject to any disclaimer, the term of this patent is extended or adjusted under 35 U.S.C. 154(b) by 527 days.

(21) Appl. No.: 14/080,709

(22) Filed: Nov. 14, 2013

(65) Prior Publication Data

US 2014/0134924 A1 May 15, 2014

(30) Foreign Application Priority Data

Nov. 15, 2012 (JP) ..... 2012-250928

(51) Int. Cl.
*B24B 37/005* (2012.01)
*B24B 37/30* (2012.01)
*B24B 7/22* (2006.01)

(52) U.S. Cl.
CPC ..... *B24B 37/005* (2013.01); *B24B 7/228* (2013.01); *B24B 37/30* (2013.01)

(58) Field of Classification Search
CPC ..... B24B 49/10; B24B 49/16; B24B 37/005; B24B 37/04; B24B 37/042; B24B 37/30; B24B 47/20; B24B 7/228; B24B 7/241
USPC ..... 451/5, 10, 11, 41, 288
See application file for complete search history.

(56) References Cited

U.S. PATENT DOCUMENTS 4,712,470 A * 12/1987 Schmitz ..... B24B 49/16 451/21
4,993,097 A * 2/1991 D'Amato ..... B23Q 15/12 15/102
5,916,009 A * 6/1999 Izumi ..... B24B 37/04 257/E21.237
5,943,726 A * 8/1999 Eitoku ..... H01L 21/67046 15/102
6,012,964 A * 1/2000 Arai ..... B24B 37/30 451/287

(Continued)

FOREIGN PATENT DOCUMENTS

JP 2000288928 A * 10/2000
JP 2008-207320 A 9/2008

(Continued)

*Primary Examiner* — Monica Carter
*Assistant Examiner* — Marcel Dion
(74) *Attorney, Agent, or Firm* — Baker & Hostetler LLP

(57) ABSTRACT

A substrate holding apparatus holds a substrate and presses the substrate against a polishing pad. The substrate holding apparatus includes a top ring configured to hold the substrate and press the substrate against the polishing pad, a vertical movement mechanism configured to vertically move the top ring, a torque detector configured to detect a torque of the vertical movement mechanism when the top ring is being lowered or being lifted by the vertical movement mechanism, and a controller in which a torque of the vertical movement mechanism when the top ring is brought into contact with a surface of the polishing pad at the time of a pad search is preset as a torque limit value. The controller calculates a torque correction amount from the torque detected by the torque detector and a preset reference value, and corrects the torque limit value by using the torque correction amount.

21 Claims, 1 Drawing Sheet

(56) References Cited

U.S. PATENT DOCUMENTS 6,139,400 A * 10/2000 Sato ..... B24B 49/16 451/10
6,402,589 B1 * 6/2002 Inaba ..... B24C 1/045 451/2
6,474,913 B2 * 11/2002 Katoh ..... B23Q 1/0009 408/1 R
6,712,670 B2 * 3/2004 de la Llera ..... B24B 49/16 451/11
7,040,954 B1 * 5/2006 McClatchie ..... B24B 49/18 451/5
2004/0029500 A1 * 2/2004 Saitoh ..... B24B 7/17 451/63
2004/0166769 A1 * 8/2004 Zelenski ..... B24B 7/06 451/5
2004/0198181 A1 * 10/2004 Tajima ..... B24B 21/004 451/5
2008/0070479 A1 3/2008 Nabeya et al.
2008/0287043 A1 11/2008 Saito et al.
2010/0035525 A1 * 2/2010 Deshpande ..... B24B 37/005 451/56
2011/0214801 A1 * 9/2011 Lindsay ..... B29D 30/54 156/96
2011/0223834 A1 * 9/2011 Moon ..... B24B 7/24 451/5
2012/0064800 A1 * 3/2012 Watanabe ..... B24B 37/005 451/5
2013/0065493 A1 * 3/2013 Takahashi ..... B24B 37/013 451/59
2014/0030957 A1 * 1/2014 Aratani ..... B24B 37/005 451/11

FOREIGN PATENT DOCUMENTS

KR 10-2011-0013896 2/2011
KR 10-2012-0026455 3/2012

* cited by examiner

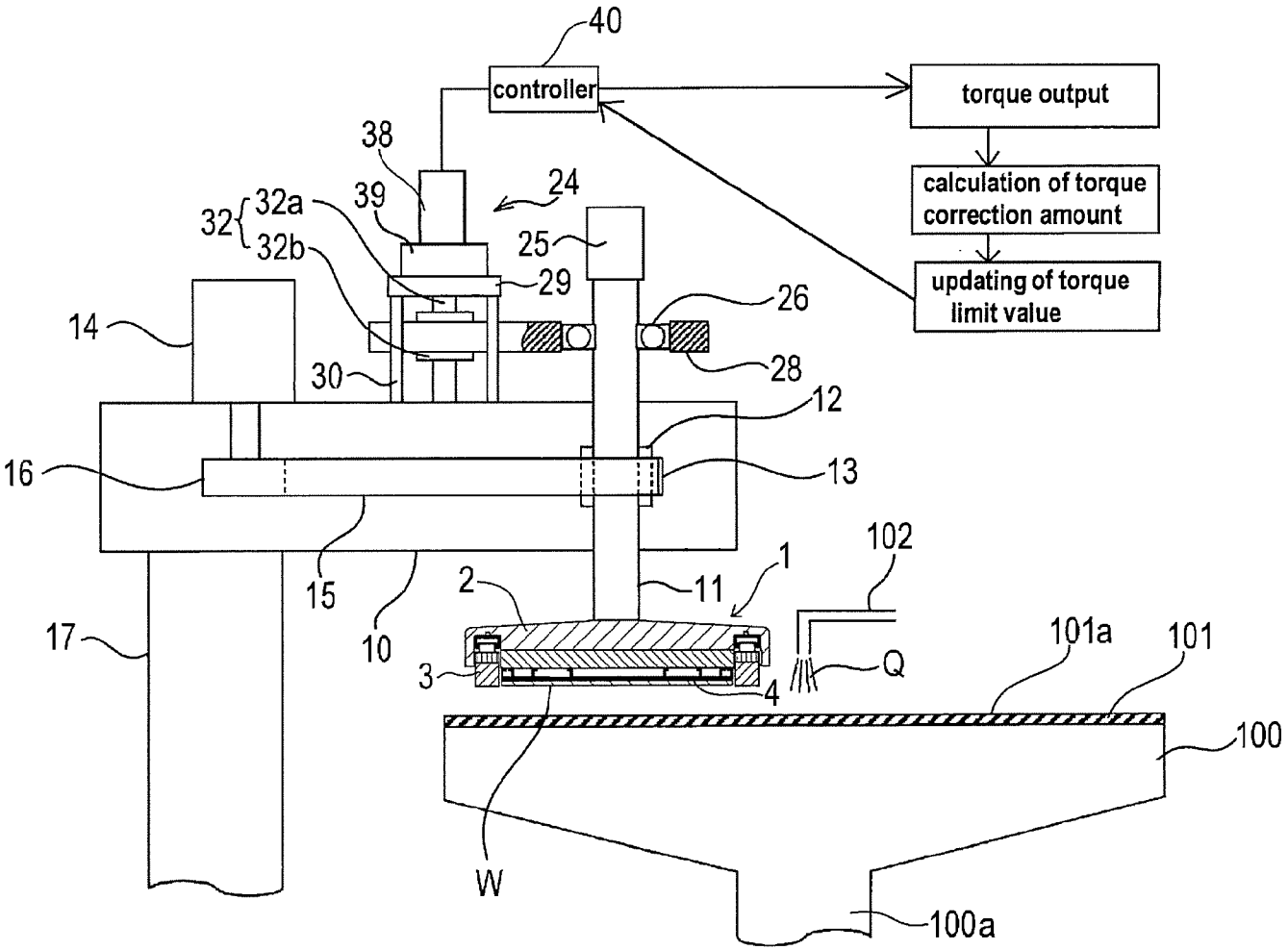
torque output
calculation of torque correction amount
updating of torque limit value
controller
40
38
39
24
25
29
26
28
12
13
32a
32b
32
30
14
16
15
10
17
1
11
2
3
4
W
102
Q
101
101a
100
100a

SUBSTRATE HOLDING APPARATUS AND POLISHING APPARATUS

CROSS REFERENCE TO RELATED APPLICATIONS

This document claims priority to Japanese Application Number 2012-250928, filed Nov. 15, 2012, the entire contents of which are hereby incorporated by reference.

BACKGROUND OF THE INVENTION

Field of the Invention

The present invention relates to a substrate holding apparatus for holding a substrate to be polished and pressing the substrate against a polishing pad (polishing surface), and more particularly to a substrate holding apparatus for holding a substrate such as a semiconductor wafer in a polishing apparatus for polishing and planarizing the substrate. Further, the present invention relates to a polishing apparatus having such substrate holding apparatus.

Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). In the chemical mechanical polishing, while a polishing liquid containing abrasive particles such as silica ($SiO_2$) therein is supplied onto a polishing surface of a polishing pad, a substrate such as a semiconductor wafer is brought into sliding contact with the polishing surface and polished by using the polishing apparatus.

The polishing apparatus which performs the above-mentioned CMP process includes a polishing table having a polishing surface formed by a polishing pad, and a substrate holding apparatus, which is referred to as a top ring or a polishing head, for holding a substrate such as a semiconductor wafer. When the substrate is polished with such a polishing apparatus, the substrate is held and pressed against the polishing surface of the polishing pad under a predetermined pressure by the substrate holding apparatus. At this time, the polishing table and the substrate holding apparatus are moved relative to each other to bring the substrate into sliding contact with the polishing surface, so that the surface of the substrate is polished to a flat mirror finish.

If a relative pressing force produced between the substrate being polished and the polishing surface of the polishing pad is not uniform over the entire surface of the substrate, then the substrate is insufficiently or excessively polished depending on the pressing force applied to each area of the substrate. Therefore, it has been attempted that a substrate-holding surface of the substrate holding apparatus is formed by an elastic membrane made of an elastic material such as rubber, and a plurality of pressure chambers to which a pressurized fluid is supplied are formed at the reverse side of the elastic membrane and a fluid pressure such as air pressure is applied to the pressure chambers to uniform the pressing force applied to the substrate over the entire surface of the substrate.

In the above polishing apparatus, when the substrates are polished using a polishing pad made of synthetic resin, the polishing pad is progressively worn each time it is dressed and with the passage of polishing time. In order to keep the surface pressure distribution unchanged on the substrate held by the top ring, it is necessary to keep the distance between the top ring and the polishing pad constant during polishing.

When a product substrate is processed, the top ring is moved by a servomotor to a contact position (height), between a substrate held by the top ring and the polishing pad, determined beforehand by an operation referred to as pad search which is a function or action for determining a reference height position for polishing, and the product substrate is polished at the contact position (height) in a positioning control state. In some cases, the top ring is lifted from the contact position (height) to a certain height corresponding to a clearance between the polishing pad and the membrane, and the product substrate is polished in a positioning control state.

In the operation of pad search for determining the above contact position, for example, if the contact position is determined by simply measuring a distance to the polishing pad by a distance measuring device or the like, it may cause considerable error because the polishing pad is made of an elastic material and has a concavo-convex surface. Therefore, it has been customary that the top ring is lowered from a lifted position onto the surface of the polishing pad to detect a contact force against the polishing pad, thereby determining the contact position. The contact force is detected by monitoring an output torque (output current) of the servomotor of a positioning mechanism for lifting and lowering the top ring.

The function or action referred to as the pad search is a function for determining the contact position (height) between the substrate held by the top ring and the polishing pad from a certain reference height (for example, a transfer height in a horizontal direction) of the top ring. When performing this function, a torque limit value which has been obtained beforehand is set, and the top ring is stopped at the position at which the top ring is brought into contact with the polishing pad and the output torque of the servomotor becomes the preset torque limit value, and then this position is set as a reference position (height) for polishing.

The pad search operation will be described further in detail below. The torque limit value for the pad search is determined beforehand. The method for determining the torque limit value is as follows: For example, first, an initial value of the torque limit value is set from a design value. Then, a load cell is placed on the polishing table to which the polishing pad is attached, and the top ring is lowered until the set torque limit value (initial value) is reached, and a lowering thrust force of the top ring shaft is measured by the load cell to determine the relationship between the torque limit value and the thrust force. Specifically, if the measured value of the thrust force is larger than the reference (design) thrust force (value having a certain range), the torque limit value is made smaller, and the same measurement is performed again. Conversely, if the measured value of the thrust force is smaller than the reference (design) thrust force (value having a certain range), the torque limit value is made larger, and the same measurement is repeated, whereby the torque limit value which falls within the range of the reference (design) thrust force (value having a certain range) is determined (searched). The torque limit value thus determined is set as a torque limit value for the pad search.

The inventors of the present invention have conducted various experiments and obtained the following knowledge. Specifically, in the polishing apparatus described above, a loss torque of the vertical movement mechanism for vertically moving the top ring is decreased by operation history, compared to startup operation. Because the limit value is set for the motor torque of the vertical movement mechanism to determine the position at which the top ring is brought into contact with the surface of the polishing pad, the change of the loss torque of the vertical movement mechanism has an effect on a thrust force for pressing the top ring against the surface of the polishing pad. When the loss torque of the vertical movement mechanism is reduced, the thrust force for pressing the top ring against the surface of the polishing pad is increased by an amount corresponding to the reduction, thus pressing the top ring against the polishing pad with more powerful force. Consequently, if the pad search is conducted at a predetermined period determined by the number of processed substrates, the wear amount of a retainer ring, or the like, the top ring is pressed excessively. Therefore, a gap between the surface of the polishing pad and the elastic membrane provided in the top ring for pressing the substrate cannot be kept constant. As a result, the polishing process condition varies, causing adverse effect on a process performance, such as poor uniformity of the surface, being polished, of the substrate.

SUMMARY OF THE INVENTION

Based on the above knowledge obtained from various experiments, the present invention has been made. It is therefore an object of the present invention to provide a substrate holding apparatus which can detect a time-dependent change of loss torque of a vertical movement mechanism for moving a top ring vertically to correct a torque limit value, used as a reference for a pad search, by using the detected time-dependent change of the loss torque, thereby obtaining an accurate height of a surface of a polishing pad at the time of the pad search.

Another object of the present invention is to provide a polishing apparatus having such substrate holding apparatus.

In order to achieve the above object, according to one aspect of the present invention, there is provided a substrate holding apparatus for holding a substrate to be polished and pressing the substrate against a polishing pad, the substrate holding apparatus comprising: a top ring configured to hold the substrate and press the substrate against the polishing pad; a vertical movement mechanism configured to vertically move the top ring; a torque detector configured to detect a torque of the vertical movement mechanism when the top ring is being lowered or being lifted by the vertical movement mechanism; and a controller in which a torque of the vertical movement mechanism when the top ring is brought into contact with a surface of the polishing pad at the time of a pad search is preset as a torque limit value, the pad search being defined as a process in which the top ring is lowered and brought into contact with the surface of the polishing pad; wherein the controller calculates a torque correction amount from the torque detected by the torque detector and a preset reference value, and corrects the torque limit value by using the torque correction amount.

According to the present invention, a torque of the vertical movement mechanism when the top ring is brought into contact with the surface of the polishing pad, at the time of the pad search in which the top ring is lowered and brought into contact with the surface of the polishing pad, is preset as the torque limit value. A torque of the vertical movement mechanism is detected when the top ring is being lowered or being lifted at the time of the pad search or the substrate processing, then a torque correction amount is calculated from the detected torque and the reference value determined by the torque of the vertical movement mechanism at the time of the preceding pad search, the preceding substrate polishing process, or the like. Then, the preset torque limit value is corrected by using the torque correction amount.

According to the present invention, the torque of the vertical movement mechanism for the top ring is detected at the time of the preceding pad search or the preceding substrate polishing process, and the detected torque is set as the reference value. The torque of the vertical movement mechanism for the top ring at the time of a subsequent pad search or a subsequent substrate polishing process is detected, and a time-dependent change of loss torque of the vertical movement mechanism is detected by comparing the detected torque and the reference value. The time-dependent change of loss torque is determined as a torque correction amount, then the torque limit value for the pad search is corrected by using the torque correction amount. Accordingly, even if the loss torque of the vertical movement mechanism for the top ring is changed with the passage of time, the height of the surface of the polishing pad can be detected by substantially the same pressing force (thrust force) at the time of the pad search as an initial startup of the polishing apparatus.

In a preferred aspect of the present invention, the reference value is determined from a torque of the vertical movement mechanism at the time of the preceding pad search.

According to the present invention, the torque of the vertical movement mechanism is detected when the top ring is being lowered or being lifted, at the time of the preceding pad search, and the detected torque is set as the reference value.

In a preferred aspect of the present invention, the reference value is determined from a torque of the vertical movement mechanism at the time of the preceding substrate polishing process.

According to the present invention, the torque of the vertical movement mechanism is detected when the top ring is being lowered or being lifted, at the time of the preceding substrate polishing process, and the detected torque is set as the reference value.

In a preferred aspect of the present invention, the reference value is a center value of a threshold having a predetermined range with an upper limit and a lower limit.

In a preferred aspect of the present invention, the center value of the threshold is an average torque when the top ring is being lowered or lifted at a constant velocity.

According to the present invention, an average torque of the vertical movement mechanism when the top ring is being moved at a constant velocity corresponds to a torque in a stable condition where an acceleration of the movement of the top ring is zero. Thus, the torque corresponds to a sum of a mechanical loss of the vertical movement mechanism and a gravity load (mass). The torque during lowering of the top ring corresponds to a value obtained by subtracting the gravity load from the mechanical loss. The torque during lifting of the top ring corresponds to a value obtained by adding the mechanical loss to the gravity load. Since the gravity load is estimated as a constant value, a time-dependent change of the mechanical loss can be detected by monitoring the torque when the top ring is being lifted or being lowered. Therefore, the reference value should be an average torque at a constant velocity movement when the top ring is being lowered or being lifted by the vertical movement mechanism in the operation for initially determining the torque limit value. The reference value, i.e. the center value of the threshold, can be an accurate value with less error. At this time, in the case where an average torque during lowering of the top ring is used as the reference value, the time-dependent change of mechanical loss is obtained by monitoring the average torque when the top ring is being lowered in subsequent operations.

In a preferred aspect of the present invention, the torque correction amount is a difference between the torque detected by the torque detector and the reference value.

According to the present invention, in the case where the torque detected by the torque detector becomes smaller than the preset reference value, a difference between the detected torque and the reference value is subtracted from the torque limit value which has been used for the pad search. The reason of subtraction is that the mechanical loss of the vertical movement mechanism is decreased to reduce the torque needed for moving the top ring, and thus a thrust force for pressing the top ring against the surface of the polishing pad is increased if the torque limit value for pad search remains the same. On the other hand, in the case where the torque detected by the torque detector becomes larger than the preset reference value, the difference between the detected torque and the reference value is added to the torque limit value which has been used for the pad search.

In a preferred aspect of the present invention, the torque detector detects the torque when the top ring is being lowered or lifted at a constant velocity.

According to the present invention, since the torque of the vertical movement mechanism when the top ring is being moved at a constant velocity corresponds to a torque in a stable condition where an acceleration of the movement of the top ring is zero, the torque detector can detect an accurate torque without error.

According to another aspect of the present invention, there is provided a polishing apparatus for polishing a substrate, comprising: a polishing table having a polishing pad; and a substrate holding apparatus for holding a substrate to be polished and pressing the substrate against the polishing pad; the substrate holding apparatus comprising: a top ring configured to hold the substrate and press the substrate against the polishing pad; a vertical movement mechanism configured to vertically move the top ring; a torque detector configured to detect a torque of the vertical movement mechanism when the top ring is being lowered or being lifted by the vertical movement mechanism; and a controller in which a torque of the vertical movement mechanism when the top ring is brought into contact with a surface of the polishing pad at the time of a pad search is preset as a torque limit value, the pad search being defined as a process in which the top ring is lowered and brought into contact with the surface of the polishing pad; wherein the controller calculates a torque correction amount from the torque detected by the torque detector and a preset reference value, and corrects the torque limit value by using the torque correction amount.

According to the present invention, since the substrate holding apparatus has a function to correct the torque limit value for detecting that the top ring is brought into contact with the surface of the polishing pad at the time of the pad search by the top ring, the time-dependent change of loss torque of the vertical movement mechanism for the top ring can be corrected. Accordingly, even if the loss torque of the vertical movement mechanism for the top ring is changed with the passage of time, the height of the surface of the polishing pad can be detected at the time of the pad search by substantially the same pressing force (thrust force) as the initial startup of the polishing apparatus. As a result, a chemical mechanical polishing apparatus in which a gap between the surface of the polishing pad and the elastic membrane of the top ring, having an important role in a polishing process, can be highly-reproducibly controlled, can be provided.

According to still another aspect of the present invention, there is provided a polishing method for polishing a substrate by holding the substrate and pressing the substrate against a polishing pad on a polishing table by a top ring, comprising: preset a torque limit value of a vertical movement mechanism for vertically moving the top ring; detecting a torque of the vertical movement mechanism by lowering or lifting the top ring; calculating a torque collection amount from the detected torque and a preset reference value; collecting the torque limit value by using the torque collection amount; and lowering the top ring until the collected torque limit value is reached, and polishing the substrate.

BRIEF DESCRIPTION OF THE DRAWINGS

FIG. 1 is a schematic view showing an entire structure of a polishing apparatus according to an embodiment of the present invention.

DETAILED DESCRIPTION OF THE PREFERRED EMBODIMENTS

A substrate holding apparatus and a polishing apparatus according to an embodiment of the present invention will be described below with reference to FIG. 1.

FIG. 1 is a schematic view showing an entire structure of a polishing apparatus according to the present invention. As shown in FIG. 1, the polishing apparatus comprises a polishing table 100, and a top ring 1 constituting a substrate holding apparatus for holding a substrate such as a semiconductor wafer as an object to be polished and pressing the substrate against a polishing pad on the polishing table.

The polishing table 100 is coupled via a table shaft 100*a* to a polishing table motor (not shown) disposed below the polishing table 100. Thus, the polishing table 100 is rotatable about the table shaft 100*a*. A polishing pad 101 is attached to an upper surface of the polishing table 100. An upper surface 101*a* of the polishing pad 101 constitutes a polishing surface configured to polish the substrate such as a semiconductor wafer. A polishing liquid supply nozzle 102 is provided above the polishing table 100 to supply a polishing liquid Q onto the polishing pad 101 on the polishing table 100.

As shown in FIG. 1, the top ring 1 basically comprises a top ring body 2, also referred to as carrier, for holding a substrate W and pressing the substrate W against the surface (polishing surface) 101*a* of the polishing pad 101, and a retainer ring 3 for directly pressing the polishing pad 101.

The top ring body (carrier) 2 is in the form of a circular plate, and the retainer ring 3 is attached to a peripheral portion of the top ring body 2. The top ring body 2 is made of resin such as engineering plastics (e.g. PEEK). The top ring 1 has an elastic membrane (membrane) 4 attached to a lower surface of the top ring body 2. The elastic membrane 4 is brought into contact with a rear face of the substrate held by the top ring 1. A plurality of pressure chambers are defined between an upper surface of the elastic membrane (membrane) 4 and the lower surface of the top ring body (carrier) 2. The elastic membrane (membrane) 4 is made of a highly strong and durable rubber material such as ethylene propylene rubber (EPDM), polyurethane rubber, silicone rubber, or the like.

The top ring 1 is connected to a top ring shaft 11, and the top ring shaft 11 is vertically movable with respect to a top ring head 10 by a vertical movement mechanism 24. When the top ring shaft 11 moves vertically, the top ring 1 is lifted and lowered as a whole for positioning with respect to the top ring head 10. A rotary joint 25 is mounted on the upper end of the top ring shaft 11.

Various kinds of polishing pads are sold on the market. For example, some of these are SUBA800, IC-1000, and IC-1000/SUBA400 (two-layer cloth) manufactured by Dow Chemical Company, and Surfin xxx-5 and Surfin 000 manufactured by Fujimi Inc. SUBA800, Surfin xxx-5, and Surfin 000 are non-woven fabrics bonded by urethane resin, and IC-1000 is rigid foam polyurethane (single-layer). Foam polyurethane is porous and has a large number of fine recesses or holes formed in its surface.

The vertical movement mechanism 24, which vertically moves the top ring shaft 11 and the top ring 1, has a bridge 28 supporting the top ring shaft 11 in a manner such that the top ring shaft 11 is rotatable via a bearing 26, a ball screw 32 mounted on the bridge 28, a support stage 29 which is supported by poles 30, and an AC servomotor 38 provided on the support stage 29. The ball screw 32 is coupled to the AC servomotor 38 via a reducer 39. The support stage 29, which supports the AC servomotor 38, is fixed to the top ring head 10 via the poles 30.

The ball screw 32 has a screw shaft 32*a* which is coupled to the reducer 39, and a nut 32*b* into which the screw shaft 32*a* is threaded. The top ring shaft 11 is configured to be vertically movable together with the bridge 28. Accordingly, when the AC servomotor 38 is driven, the bridge 28 is vertically moved through the ball screw 32. As a result, the top ring shaft 11 and the top ring 1 are vertically moved. The AC servomotor 38 is connected to a controller 40.

Further, the top ring shift 11 is connected to a rotary sleeve 12 by a key (not shown). The rotary sleeve 12 has a timing pulley 13 fixedly disposed therearound. A top ring motor 14 is fixed to the top ring head 10. The timing pulley 13 is operatively coupled to a timing pulley 16 provided on the top ring motor 14 by a timing belt 15. Therefore, when the top ring motor 14 is driven, the timing pulley 16, the timing belt 15 and the timing pulley 13 are rotated to rotate the rotary sleeve 12 and the top ring shaft 11 in unison with each other, thus rotating the top ring 1. The top ring head 10 is supported on a top ring head shaft 17 which is rotatably supported by a frame (not shown).

When the substrates W are polished by the polishing apparatus shown in FIG. 1, the thickness of the polishing pad 101 varies at all times because the polishing pad 101 is progressively worn, dressed, and replaced. In the polishing apparatus for pressing the substrate W against the polishing pad 101 by an inflated elastic membrane (membrane) 4, the range in which the outer circumferential area of the substrate and the elastic membrane are brought into contact with each other, and the surface pressure distribution over the outer circumferential area of the substrate vary depending on the distance between the elastic membrane (membrane) 4 and the substrate W. In this case, in order to prevent the surface pressure distribution over the substrate W from varying as the polishing process progresses, it is necessary to keep the distance between the top ring 1 and the surface (polishing surface) 101*a* of the polishing pad 101 constant at the time of polishing. For keeping the distance between the top ring 1 and the surface (polishing surface) 101*a* of the polishing pad 101 constant, it is necessary to detect the height (vertical position) of the polishing surface of the polishing pad 101 and adjust a lowered position of the top ring 1 after the polishing pad 101 is replaced and initially dressed by the dresser, for example. The process of detecting the height (vertical position) of the polishing surface of the polishing pad 101 is referred to as "pad search" by the top ring.

The pad search by the top ring is carried out by detecting the vertical position (height) of the top ring 1 when the lower surface of the top ring 1 or the lower surface of the substrate W is brought into contact with the surface (polishing surface) of the polishing pad 101. Specifically, in the pad search by the top ring, the top ring 1 is lowered by driving the AC servomotor 38 while the number of revolutions of the AC servomotor 38 is being counted and integrated by an encoder combined with the AC servomotor 38. When the lower surface of the top ring 1 is brought into contact with the polishing surface of the polishing pad 101, the load on the AC servomotor 38 increases, and the current flowing through the AC servomotor 38 increases. Therefore, the torque is detected by a torque detector, based on the current flowing through the AC servomotor 38. When the detected torque becomes large, the controller 40 judges that the lower surface of the top ring 1 is brought into contact with the surface (polishing surface) of the polishing pad 101. When it is judged that the lower surface of the top ring 1 is brought into contact with the surface of the polishing pad 101, the controller 40 calculates the lowered distance (position) of the top ring 1 from the integration value of the encoder of the AC servomotor 38, and stores the calculated lowered distance. The controller 40 then obtains the vertical position (height) of the surface (polishing surface) of the polishing pad 101 from the lowered distance of the top ring 1, and calculates a setting position at the time of polishing of the top ring 1 from the vertical position (height) of the surface of the polishing pad 101.

In the polishing apparatus as shown in FIG. 1, when the operation of the polishing is repeated, a loss torque of the vertical movement mechanism 24 for vertically moving the top ring 1 is decreased compared to startup operation. In this case, because the position at which the top ring 1 is brought into contact with the surface of the polishing pad 101 is detected by setting a limit value for the motor torque of the vertical movement mechanism 24, it is necessary to feed back a time-dependent change of the loss torque of the vertical movement mechanism 24 properly, to the motor torque limit value for the pad search.

Therefore, in the present invention, the controller 40 of the AC servomotor 38 has a torque detector (not shown) for detecting a torque of the vertical movement mechanism 24 when the top ring 1 is being lowered or lifted by the vertical movable mechanism 24. As shown in FIG. 1, in the controller 40 of the AC servomotor 38, a torque output is obtained from a monitored current output of the motor, and the torque correction amount is calculated based on the obtained torque output, and then the torque limit value is updated.

Methods for correcting the torque limit value will be described below.

1) A method for correcting the torque limit value based on a monitored current value during a constant velocity movement when the top ring is being lifted or lowered for the normal operation:

A torque during the constant velocity movement is obtained from the monitored current output (value) of the motor when the top ring is being lifted or lowered at a constant velocity. The torques during lifting movement and the torques during lowering movement are stored separately for data accumulation, or one of the torques during lifting movement and the torques during lowering movement is stored for data accumulation. If the monitored value exceeds a preset threshold for a reference value (this reference value is a reference value of a motor current value when the top ring is being lifted or lowered. The reference value when the top ring is being lifted or lowered is determined beforehand, separately from the reference value of the torque limit value), there are two methods as described below. Here, the threshold is defined as values having a predetermined range with an upper limit and a lower limit, and a value intermediate between the upper limit and the lower limit is defined as a center value, i.e. reference value.

In the first method, an alarm is issued. The alarm status is checked by an operator. If the alarm status is recognized as the relevant alarm, the torque limit value for the pad search is updated. In this case, in order to update the torque limit value, as described above, a load cell is provided on the polishing table to determine a torque limit value.

In the second method, a difference between the monitored value (monitored torque) and the reference value is calculated to update the torque limit value for the pad search. Update history information is stored and sent to a higher-level controller.

The update history information: 1) is reflected to a processing history information of the processed wafers (substrates), 2) is utilized to detect an abnormality of a mechanism system by observing the update history information for a long period of time, 3) is utilized to judge whether the update is correct or not.

In the case where the monitored value (monitored torque) becomes smaller than the preset threshold, a difference ΔT between the monitored value and the center value (reference value) of the threshold is subtracted from the torque limit value which has been used for the pad search. The reason of subtraction is that a mechanical loss of the vertical movement mechanism is decreased to reduce the torque needed for moving the top ring at a constant velocity, and thus a thrust force for pressing the top ring against the surface of the polishing pad is increased if the torque limit value for pad search remains the same.

In the case where the monitored value becomes larger than the preset threshold, the difference ΔT between the monitored value and the center value (reference value) of the threshold is added to the torque limit value which has been used for the pad search.

2) A method for correcting the torque limit value based on an average of monitored current values during a constant velocity movement when the top ring is being lowered for the pad search:

An average torque is arithmetically calculated from the average of the monitored current values when the top ring is being lowered at a constant velocity for the pad search. In the case where the average torque exceeds the preset threshold, the torque limit value is updated based on a difference between the average torque and the center value (reference value) of the threshold. Update history information is stored and sent to a higher-level controller.

The update history information: 1) is reflected to a processing history information of the processed wafers (substrates), 2) is utilized to detect an abnormality of a mechanism system by observing the update history information for a long period of time, 3) is utilized to judge whether the update is correct or not.

In the case where the average torque becomes smaller than the preset threshold, the difference ΔT between the average torque and the center value (reference value) of the threshold is subtracted from the torque limit value which has been used for the pad search. The reason of subtraction is that the mechanical loss of the vertical movement mechanism is decreased to reduce the torque needed for moving the top ring at a constant velocity, and thus a thrust force for pressing the top ring against the surface of the polishing pad is increased if the torque limit value for pad search remains the same.

In the case where the average torque becomes larger than the preset threshold, the difference ΔT between the average torque and the center value (reference value) of the threshold is added to the torque limit value which has been used for the pad search.

The center value (reference value) of the threshold may be an average torque during a constant velocity movement when the top ring is lowered for the preceding pad search.

The center value (reference value) of the threshold when the top ring is lifted may be an average torque during the constant velocity movement when the top ring is lifted for the preceding pad search.

In the correction methods 1) and 2), the normal operation is defined as an operation in which a normal polishing process of the substrate is being conducted. The pad search is defined as a pad search which is conducted in an initial startup of the polishing apparatus or after replacement of the polishing pad. After the normal operation (polishing) is started, a wear amount of the retainer ring of the top ring is changed depending on the number of processed substrates. Thus, in addition to the above pad search for the initial startup and the like, the pad search is defined as a pad search which is additionally conducted in the middle of polishing operation based on the wear amount of the retainer ring or the number of processed substrates.

In considering how to detect the mechanical loss of the vertical movement mechanism for the top ring as accurately as possible, the number of times of the pad search is increased, thus increasing loss of time. As in the correction method 1), the torques are monitored during the normal operation to evaluate the change of the torques and the correction value is calculated based on data of the preceding processing operation of ten substrates before the pad search, and thus an accurate correction (correction of the torque limit value) can be achieved without increasing loss of time.

On the other hand, as in the correction method 2), the mechanical loss is estimated from torques during the constant velocity movement when the top ring is being lowered for the pad search to update the torque limit value, thereby determining the position at which the top ring is brought into contact with the polishing pad under the condition of stable axial thrust force, as the height of the surface of the polishing pad. This method is simple and has an advantage that the correction of the torque limit value is completed in the operation of the pad search which is included in a system software.

Further, in the correction methods 1) and 2), torques are detected while the top ring is being moved at a constant velocity. This is because mechanical loss component should be detected in stable condition as much as possible and under the condition that acceleration of the movement of the top ring is zero. In the case where the acceleration is not zero, energy (positive or negative) for changing an object having a certain mass into a certain velocity is supplied, and thus a component corresponding to such energy is included in the mechanical loss component. However, since this component is such a component as to last for a relatively short period, the top ring does not necessarily need to move at a constant velocity when the torque is detected.

The vertical movement mechanism for the top ring is not limited to a thrust force source using the servomotor. Other thrust force sources such as a linear motor may be used for lifting and lowering the top ring shaft. In the case of using an electromagnetic motor as the thrust force source, the torque (thrust force) is obtained from a monitored current value, and the obtained torque is used for correction. In the case of using a pressure, such as an oil hydraulic cylinder, the thrust force is obtained from a monitored pressure value to monitor a time-dependent change of the loss torque (thrust force), and the change of the loss torque is used for correction.

Although certain preferred embodiments of the present invention have been shown and described in detail, it should be understood that various changes and modifications may be made therein without departing from the scope of the appended claims.

What is claimed is:

1. A substrate holding apparatus for holding a substrate to be polished and pressing the substrate against a polishing pad, said substrate holding apparatus comprising:

a top ring configured to hold the substrate and press the substrate against the polishing pad;

a vertical movement mechanism configured to vertically move said top ring;

a torque detector configured to detect a torque of said vertical movement mechanism when said top ring is being lowered or being lifted by said vertical movement mechanism; and a controller in which a torque of said vertical movement mechanism when said top ring is brought into contact with a surface of the polishing pad at the time of a pad search is preset as a torque limit value, said pad search being defined as a process in which said top ring is lowered and brought into contact with the surface of the polishing pad to determine a contact position between the substrate held by the top ring and the polishing pad, wherein said controller is configured to preset a reference value from a torque detected by said torque detector when said top ring is being lowered or being lifted by said vertical movement mechanism, wherein said controller is configured to calculate a torque correction amount from said reference value and a torque which is detected by said torque detector when said top ring is being lowered or being lifted by said vertical movement mechanism, after said reference value is preset, and wherein said controller is configured to correct said torque limit value by using said torque correction amount.

2. The substrate holding apparatus according to claim 1, wherein said reference value is determined from a torque of said vertical movement mechanism at the time of said pad search.

3. The substrate holding apparatus according to claim 1, wherein said reference value is determined from a torque of said vertical movement mechanism at the time of a preceding substrate polishing process.

4. The substrate holding apparatus according to claim 1, wherein said reference value is a center value of a threshold having a predetermined range with an upper limit and a lower limit.

5. The substrate holding apparatus according to claim 4, wherein said center value of said threshold is an average torque when said top ring is being lowered or lifted at a constant velocity.

6. The substrate holding apparatus according to claim 1, wherein said torque correction amount is a difference between said reference value and said torque detected by said torque detector after said reference value is preset when said top ring is being lowered or being lifted by said vertical movement mechanism.

7. The substrate holding apparatus according to claim 1, wherein said torque detector detects said torque when said top ring is being lowered or lifted at a constant velocity.

8. A polishing apparatus for polishing a substrate, comprising:

a polishing table having a polishing pad; and a substrate holding apparatus for holding a substrate to be polished and pressing the substrate against the polishing pad;

said substrate holding apparatus comprising:

a top ring configured to hold the substrate and press the substrate against the polishing pad;

a vertical movement mechanism configured to vertically move said top ring;

a torque detector configured to detect a torque of said vertical movement mechanism when said top ring is being lowered or being lifted by said vertical movement mechanism; and a controller in which a torque of said vertical movement mechanism when said top ring is brought into contact with a surface of the polishing pad at the time of a pad search is preset as a torque limit value, said pad search being defined as a process in which said top ring is lowered and brought into contact with the surface of the polishing pad to determine a contact position between the substrate held by the top ring and the polishing pad, wherein said controller is configured to preset a reference value from a torque detected by said torque detector when said top ring is being lowered or being lifted by said vertical movement mechanism, wherein said controller is configured to calculate a torque correction amount from said reference value and a torque which is detected by said torque detector when said top ring is being lowered or being lifted by said vertical movement mechanism, after said reference value is preset, and wherein said controller is configured to correct said torque limit value by using said torque correction amount.

9. The polishing apparatus according to claim 8, wherein said reference value is determined from a torque of said vertical movement mechanism at the time of said pad search.

10. The polishing apparatus according to claim 8, wherein said reference value is determined from a torque of said vertical movement mechanism at the time of a preceding substrate polishing process.

11. The polishing apparatus according to claim 8, wherein said reference value is a center value of a threshold having a predetermined range with an upper limit and a lower limit.

12. The polishing apparatus according to claim 11, wherein said center value of said threshold is an average torque when said top ring is being lowered or lifted at a constant velocity.

13. The polishing apparatus according to claim 8, wherein said torque correction amount is a difference between said reference value and said torque detected by said torque detector after said reference value is preset when said top ring is being lowered or being lifted by said vertical movement mechanism.

14. The polishing apparatus according to claim 8, wherein said torque detector detects said torque when said top ring is being lowered or lifted at a constant velocity.

15. A polishing method for polishing a substrate by holding the substrate and pressing the substrate against a polishing pad on a polishing table by a top ring, comprising:

presetting a torque limit value from a torque of a vertical movement mechanism for vertically moving said top ring when said top ring is brought into contact with a surface of the polishing pad at the time of a pad search, said pad search being defined as a process in which said top ring is lowered and brought into contact with the surface of the polishing pad to determine a contact position between the substrate held by the top ring and the polishing pad;

presetting a reference value from a torque of said vertical movement mechanism, said torque being detected by a torque detector when said top ring is being lowered or being lifted by said vertical movement mechanism;

detecting a torque of said vertical movement mechanism by said torque detector when said top ring is being lowered or being lifted by said vertical movement mechanism, after said reference value is preset;

calculating a torque correction amount from said reference value and said torque which is detected by said torque detector when said top ring is being lowered or being lifted by said vertical movement mechanism, after said reference value is preset;

correcting said torque limit value by using said torque correction amount; and lowering said top ring until said corrected torque limit value is reached, and polishing the substrate at the contact position according to said corrected torque limit value.

16. The polishing method according to claim 15, wherein said reference value is determined from a torque of said vertical movement mechanism at the time of said pad search.

17. The polishing method according to claim 15, wherein said reference value is determined from a torque of said vertical movement mechanism at the time of a preceding substrate polishing process.

18. The polishing method according to claim 15, wherein said reference value is a center value of a threshold having a predetermined range with an upper limit and a lower limit.

19. The polishing method according to claim 18, wherein said center value of said threshold is an average torque when said top ring is being lowered or lifted at a constant velocity.

20. The polishing method according to claim 15, wherein said torque correction amount is a difference between said reference value and said torque which is detected after said reference value is preset when said top ring is being lowered or being lifted by said vertical movement mechanism.

21. The polishing method according to claim 15, wherein said torque of said vertical movement mechanism is detected when said top ring is being lowered or lifted at a constant velocity.

* * * * *